US005188712A

United States Patent [19]

Dilmore et al.

[11] Patent Number: 5,188,712

[45] Date of Patent: Feb. 23, 1993

[54] DIAPHRAGM FOR USE IN CHLOR-ALKALI CELLS

[75] Inventors: Colonel R. Dilmore, Jeannette; Bernard A. Maloney, Murrysville, both of Pa.

[73] Assignee: PPG Industries, Inc., Pittsburgh, Pa.

[21] Appl. No.: 637,107

[22] Filed: Jan. 3, 1991

[51] Int. Cl.[5] ..... C25B 1/16; C25B 13/04

[52] U.S. Cl. ..... 204/98; 204/128; 204/295; 204/296; 427/376.1; 427/376.2

[58] Field of Search ..... 204/295, 296, 98, 128, 204/129; 427/58, 77, 376.1, 376.2

[56] References Cited

U.S. PATENT DOCUMENTS 4,170,537 10/1979 Simons ..... 204/296
4,170,538 10/1979 Simmons ..... 204/295
4,278,524 7/1981 Kadija ..... 204/252
4,680,101 7/1987 Darlington et al. ..... 204/295
4,853,101 8/1989 Hruska et al. ..... 204/295

*Primary Examiner*—John Niebling
*Assistant Examiner*—Kathryn Gorgos
*Attorney, Agent, or Firm*—Edward J. Whitfield; Irwin M. Stein

[57] ABSTRACT

A liquid permeable diaphragm for use in an electrolytic chlor-akali cell, the diaphragm being made of fibrous material and having deposited thereon and cementitiously bonded to the anode face thereof at least one topcoating of inorganic, particulate, refractory material. The interstices of the fibrous matrix of the diaphragm may also have particulate zirconia deposited therein.

32 Claims, No Drawings

DIAPHRAGM FOR USE IN CHLOR-ALKALI CELLS

BACKGROUND OF THE INVENTION

Chlorine, hydrogen and aqueous alkali metal hydroxide may be produced electrolytically in a diaphragm cell wherein alkali metal chloride brine, e.g., sodium or potassium chloride brine, is fed to the anolyte compartment of the cell, chlorine being evolved at the anode, the electrolyte percolating through a liquid permeable diaphragm into the catholyte compartment wherein hydroxyl ions and hydrogen are evolved at the cathode.

The diaphragm which separates the anolyte compartment from the catholyte compartment must be sufficiently porous to permit hydrodynamic flow of brine but must also inhibit back migration of hydroxyl ions from the catholyte compartment into the anolyte compartment as well as prevent mixing of evolved hydrogen and chlorine gases which could pose an explosive hazard.

Asbestos or asbestos in combination with various polymeric resins, particularly fluorocarbon resins (so-called modified asbestos) have long been used as diaphragm materials. Recently, due primarily to the health hazards posed by asbestos, numerous non-asbestos or synthetic diaphragms have been developed and are extensively described in the art. Such synthetic diaphragms are typically made of fibrous polymeric material resistant to the corrosive atmosphere of the cell and are typically made using perfluorinated polymeric material, e.g., polytetrafluoroethylene (PTFE). Such diaphragms may also contain various other modifiers and additives, e.g., inorganic fillers, pore formers, wetting agents, ion exchange resins or the like. Some of said synthetic diaphragms are described, for example, in U.S. Pat. Nos. 4,036,729; 4,126,536; 4,170,537; 4,210,515; 4,606,805; 4,680,101; 4,853,101 and 4,720,334.

Regardless of the nature of the diaphragm, i.e., be it asbestos, modified asbestos or synthetic, variations are often observed in cell operating characteristics, e.g., variations in diaphragm permeability and porosity, cell voltage, current efficiency and excessive hydrogen content in the evolved chlorine.

OBJECT OF THE INVENTION

It is the principal object of this invention to provide an improved liquid permeable diaphragm for use in electrolytic chlor-alkali cells which diaphragm improves cell operating characteristics by enabling desirably low cell voltage and desirably high current efficiency while minimizing contamination of evolved chlorine by hydrogen.

THE INVENTION

The foregoing object and others are accomplished in accordance with the broadest aspect of this invention by providing on the anode face of a preformed liquid permeable chlor-alkali diaphragm composed principally of fibrous material at least one topcoating comprising water-insoluble, particulate, inorganic refractory material; said topcoating serving to reduce the permeability of and provide more uniform flow characteristics to the preformed diaphragm.

The preformed diaphragm may be made of any fibrous material or combination of fibrous materials known to the chlor-alkali art and can be prepared by any technique known to the chlor-alkali art. Such diaphragms are typically made substantially of fibrous material resistant to the cell environment, such as traditionally used asbestos and, more recently, of plastic fibers such as polytetrafluoroethylene ("PTFE"). Such diaphragms can be prepared by vacuum depositing the diaphragm material from a liquid slurry onto a permeable substrate, e.g., a foraminous cathode. The foraminous cathode is electro-conductive and may be a perforated sheet, a perforated plate, metal mesh, expanded metal mesh, woven screen, metal rods or the like having openings typically in the range of from about 0.05 to about 0.125 inch in diameter. The cathode is typically fabricated of iron, iron alloy or some other metal resistant to the cell environment, e.g., nickel. The diaphragm material is typically deposited on the cathode substrate in an amount ranging from about 0.1 to about 1.0 pound per square foot of substrate; the deposited diaphragm typically having a thickness of from about 0.1 to about 0.25 inch.

Following deposition of the diaphragm material on the cathode substrate, the resultant cathode assembly, i.e., the preformed diaphragm, is subjected to further processing in accordance with this invention. The preformed diaphragm prior to processing in accordance with the invention may first be dried by heating in an oven at a temperature below the sintering or melting point of any fibrous organic material of which the preformed diaphragm is made, e.g. PTFE. Drying is typically effected at a temperature in the range of from about 50° C. to about 225° C., preferably at from about 90° C. to about 150° C. for up to about 4 hours. Of course, the diaphragm need not be dried but can be processed while still wet or damp in accordance with the invention.

In a first embodiment of this invention, the preformed diaphragm is provided on the anode face thereof with at least one topcoating comprising water-insoluble inorganic, particulate, refractory material and organic or inorganic fibrous material substantially resistant to the cell environment. The topcoat is preferably applied to the preformed diaphragm by vacuum depositing the topcoat material from an aqueous slurry of same in a manner analogous to the previously described mode of preparing the diaphragm prior to processing in accordance with this invention. Alternatively, the aqueous slurry of topcoat material may be applied to the diaphragm by dipping, brushing or spraying. The aqueous slurry of topcoat material may contain up to about 50 weight percent solids with the fibrous material comprising up to about 50 weight percent, preferably from about 2 to about 25 weight percent, of the total solids content.

The inorganic, particulate, refractory material used to topcoat the preformed diaphragm can be any hard oxide, boride, carbide, silicate, or nitride of the so-called valve metals, e.g., vanadium, chromium, zirconium, niobium, molybdenum, hafnium, tantalum, titanium and tungsten, or mixtures thereof. Other materials, e.g., silicon carbide, are also useful. The inorganic, particulate material is preferably a zirconium containing material, such as, zirconium oxide or zirconium silicate or mixtures thereof. Particle size of the inorganic particulate material typically vary over a wide range and the particle size desired depends on the structure of the preformed diaphragm and the design of the apparatus used to deposit the particulate material on the preformed diaphragm. While not wishing to be bound by any particular particle size, it has been found that materials with a mass-based median equivalent spherical diameter of from about 0.5 to about 10 microns, preferably from about 1.0 to about 5.0 microns, are especially useful. It is to be understood that, although the median particle size will be found in this range, individual size fractions with diameters up to about 40 microns and down to about 0.3 micron or less may be represented in the distribution of particle sizes. In addition, up to about 5 weight percent or so based on total solids of finely divided clay mineral may also be included in the topcoating slurry. Clay minerals, which are naturally occurring hydrated silicates of iron, magnesium and aluminum, include kaolin, montmorillonite, illite, glauconite, attapulgite and sepiolite. Of the clay minerals, attapulgite is preferred for use in accordance with the invention.

The topcoating slurry may also contain organic or inorganic fibrous material substantially resistant to the cell environment, such fibrous material including, asbestos, zirconia, polytetrafluoroethylene, magnesium oxide or fibers made from other sinterable ceramic materials. Mixtures of such fibers may also be used. Preferably the topcoating slurry contains polytetrafluoroethylene microfibers of the type prepared as described in U.S. Pat. No. 5,030,403, the teachings of which are incorporated herein by reference, vis a vis, the preparation of said microfibers. Said microfibers have an average length in the range of from about 0.2 to about 0.5 mm and an average diameter in the range of from about 10 to about 15 microns. As beforesaid, the fibrous material may constitute up to about 50 weight percent, preferably from about 2 to about 25 weight percent, of total solids in the topcoating slurry. Sufficient topcoat material is deposited on the anode face or surface of the preformed diaphragm so as to provide, on a dry basis, from about 0.05 to about 0.5 pound, preferably from about 0.2 to about 0.4 pound, of dry topcoat solids per square foot of cathode surface.

Following deposition of the topcoat material onto the anode face of the preformed diaphragm, the topcoated diaphragm is dried by heating at a temperature below the sintering or melting point of any fibrous organic material contained in either the preformed diaphragm or the topcoating, e.g., PTFE. Drying is preferably effected by heat treatment at a temperature in the range of from about 50° C. to about 225° C., preferably at a temperature of from about 90° C. to about 150° C., for up to about 4 hours. Such drying or heat treatment strengthens and improves the dimensional stability of the diaphragm.

In a second embodiment of this invention, the topcoated preformed diaphragm is further treated by contact with an aqueous solution of water-soluble hydrolyzable zirconium compound, which zirconium compound is hydrolyzed to the corresponding hydrous oxide. Drying the thus treated diaphragm not only further strengthens the topcoat but also strengthens the bond between the topcoat and the preformed diaphragm substrate and also deposits particulate zirconia in the interstices of the fibrous matrix of the preformed diaphragm to enhance its dimensional stability. In a preferred embodiment, the topcoated diaphragm is immersed in an aqueous solution of, e.g., zirconium halide, e.g., zirconyl chloride, for a time sufficient to saturate and penetrate the interstices of the diaphragm matrix. Alternatively, the solution can be applied to the diaphragm by vacuum filtration, brushing or spraying. The treated diaphragm is then contacted, preferably by immersion, with an aqueous sodium hydroxide solution for a time sufficient to precipitate hydrous oxide of zirconium within the interstices of the diaphragm matrix. Typically, immersion in and contact with an about 10 percent aqueous sodium hydroxide solution for about 2 hours will suffice to substantially completely precipitate all of the zirconium in its hydrous oxide form. Finally, the diaphragm is dried, preferably by heat treatment which heat treatment serves to further enhance overall strength and dimensional stability of the diaphragm. The diaphragm is heat treated at a temperature below the sintering or melting point of any fibrous organic material contained in either the preformed diaphragm or the topcoating. Heat treatment is effected at a temperature in the range of from about 50° C. up to about 225° C., preferably at a temperature of from about 90° C. to about 150° C. for up to about 20 hours.

It is, of course, to be understood that conversion, i.e., hydrolysis, of the zirconium halide to the hydrous oxide may be effected by contacting the impregnated diaphragm with any liquid or gaseous base, e.g., potassium hydroxide, cell liquor, ammonium hydroxide solution or ammonia gas. In a particularly preferred embodiment of this invention, the treated diaphragm is partially dewatered by, e.g. vacuum filtration, subsequent to contact with the zirconium compound solution and prior to hydrolysis of the zirconium. This partial dewatering step removes excess zirconium compound solution and results in a more uniform subsequent distribution of zirconia in the interstices of the fibrous diaphragm matrix. In accordance with this second embodiment of the invention, the topcoated diaphragm need not contain organic or inorganic fibrous material, satisfactory results being obtained by topcoating the preformed diaphragm only with particulate refractory material. Also, prior to treatment in accordance with this second embodiment, i.e., contact with the solution of water soluble zirconium containing compound, the topcoated diaphragm need not be dried or otherwise heat treated. It is, however, preferable that the topcoated diaphragm be dry to the touch to improve dimensional stability of the diaphragm and to consolidate the topcoating. The diaphragm treated in accordance with this second embodiment of the invention has, in addition to the aforesaid topcoat solide loading, from about 0.01 to about 0.1 pound of zirconia per square foot of diaphragm surface area deposited in the interstices of the fibrous matrix thereof.

Although in accordance with this second embodiment of the invention, zirconyl halide, e.g., zirconyl chloride, is the preferred source of zirconia, any water soluble, hydrolyzable zirconium compound may be used alone or in combination with zirconium halide. Examples of other zirconium compounds include zirconium ammonium carbonate and zirconyl sulfate. It is to be further understood that other inorganic, water soluble, hydrolyzable, metal salts may used along with said zirconium compounds to impregnate the diaphragm. Such other hydrolyzable metal salts include iron and magnesium salts, e.g., iron and magnesium chlorides.

The invention is further illustrated, but is not intended to be limited, by the following Examples.

EXAMPLE 1

A non-asbestos, fibrous polytetrafluoroethylene (PTFE) diaphragm having a dry weight of about 0.37–0.38 pounds per square foot of cathode area was prepared by vacuum depositing the diaphragm materials onto a steel mesh cathode from an aqueous slurry of approximately the following weight percent composition:

- 0.5% of Cellosize® QP 52 OOOH hydroxyethyl cellulose (product of Union Carbide Corp.);
- 0.08% of 1 Normal sodium hydroxide solution;
- 1.0% of Avanel® N-925 non-ionic surfactant (product of PPG Industries, Inc.);
- 0.2% of UCON® LO-500 antifoaming agent (product of Union Carbide Corp.);
- 0.02% of Ucarcide® 250 50% aqueous glutaraldehyde antimicrobial solution (product of Union Carbide Corp.);
- 0.38% of ¼" chopped 6.67 denier TEFLON® polytetrafluoroethylene floc (product of E. I. DuPont de Nemours & Co.);
- 0.18% of 6.5 micron×⅛" chopped DE fiberglass with 610 binder (product of PPG Industries, Inc.);
- 0.1% of Short Stuff® GA 844 polyethylene fibers (product of Minifibers Corp.);
- 1.1% of polytetrafluoroethylene microfibers having a length of 0.2–0.5 mm and a diameter of 10–15 microns, prepared as described in U.S. Pat. No. 5,030,403, teachings of which are incorporated by reference herein vis a vis preparation of said microfibers;
- 0.016% of Nafion® 601, a 5% solution of ion exchange material having sulfonic acid functional groups (product of DuPont); and the balance, water.

Vigorous agitation is required to adequately disperse the ingredients; a Gifford-Wood type rotor/stator agitator manufactured by Greerco Corporation was used.

The suspension was vacuum filtered onto a framed, wire mesh, steel, three-by-three inch square cathode. The vacuum was gradually increased as the foundation layer accumulated. When the cathode was withdrawn at five minutes, the vacuum had reached 15 in. Hg and a volume of 560 ml of filtrate had been removed. During the ensuing 14-minute drainage period, an additional 60 ml of filtrate was recovered from the wet fiber mat, and the vacuum fell to 4.5 in. Hg.

The aqueous suspension for the first topcoat layer had the following composition:

| | |
|---|---|
| Zirconium oxide (Zirox® 180, TAM Ceramics Co.) | 18.1% |
| PTFE microfibrils | 0.85% |
| Hydroxyethylcellulose | 0.38% |
| Glutaraldehyde | 0.008% |
| Nonionic surfactant | 0.74% |
| Antifoam | 0.15% |
| Sodium hydroxide to pH 8 to 10 | |
| Water | balance |

Energetic mechanical agitation of the first topcoat layer suspension was applied before addition of the PTFE fibrils to avoid impacting the fibrils with the inorganic particle. Shaking by hand was used to mix the fibrils.

The preformed diaphragm was laid in a horizontal position so the topcoat mixture could be poured on and spread over the mat using a spatula. A vacuum (15 in. Hg) was applied after 5 minutes. At the ninth minute, the cathode was drained in a vertical position. The process of coating and draining was repeated to a total of four coats. Finally, the cathode was held in the vertical position with the 15 in. Hg vacuum for 9 minutes. The cathode and diaphragm were dried in a laboratory oven at 114° to 122° C. for 45 minutes. The combined dry weight of both layers was 0.48 lb/sq. ft.

The cathode-diaphragm composite were immersed for 35 minutes in a solution made up of 10 wt % magnesium chloride hexahydrate, 90% water. This was followed by immersion in 10 wt % sodium hydroxide solution for 20.5 hours. The diaphragm was allowed to dry in the open air for 7 hours.

The cathode was installed in a laboratory cell with a ⅛-in. electrode gap. The anode was DSA-coated titanium (Eltech Corp.). A current of 1.0 ampere/sq.in. was applied. Brine containing 305 grams per liter of sodium chloride was supplied at a rate of approximately 2.0 ml/minute.

Diaphragms of the type described here typically do not offer enough resistance to flow to establish a sufficient differential level between the anode and cathode compartments. (A differential level ensures separation of the chlorine and hydrogen produced at the electrodes. Gas mixing can result in the creation of an explosive mixture.) In one type of commercial cell, a differential level of 12 inches or less is a matter of concern. (In laboratory cells much lower levels are tolerated, but levels comparable to the commercial case are highly desirable.) Therefore, various substances which, themselves, reduce diaphragm permeability or which form permeability reducing compounds after addition are added to the cell. Increasing the acidity of the anolyte by adding a mineral acid and increasing the brine feed rate to 150 to 200% of normal for one to three hours were used to move the acid/alkaline boundary into the diaphragm toward the cathode. This is believed to have a favorable effect on the distribution of magnesium hydroxide formed in the cell after the addition of magnesium chloride solution or alternatively, upon the addition of attapulgite clay, e.g., the class of materials sold by Engelhard Corp. under the registered trademark "Attagel". In this Example, the acid was hydrochloric acid; the pH of the anolyte was lowered by the acid addition, but not maintained. A schedule of additions to the cell in this Example are presented in the following table:

ADDITIONS TO CELL

| Day | Material Added | pH |
|---|---|---|
| 0 | Attagel® 50, 0.25 g<br>$MgCl_2$ as 1% Mg, 0.05 g Mg | 1.0 |
| 5 | Attagel® 50, 0.25 g<br>$MgCl_2$ as 1% Mg, 0.10 g Mg | 1.0 |
| 41 | $MgCl_2$ as 1% Mg, 0.05 g Mg | 1.0 |
| 51 | $MgCl_2$ as 1% Mg, 0.05 g Mg | 1.0 |
| 71 | Attagel® 50, 0.25 g | 1.0 |
| 126 | Attagel® 50, 0.25 g | 1.4 |
| 131 | $MgCl_2$ as 1% Mg, 0.05 g Mg | 1.2 |
| 183 | $MgCl_2$ as 1% Mg, 0.05 g Mg | 1.1 |
| 223 | Attagel® 50, 0.26 g | 1.0 |

The average performance data over a period of 252 days are as follows:

| | |
|---|---|
| Efficiency | 95.4% |
| Voltage at 1.0 A/sq. in | 2.89 |
| NaOH in cell liquor | 113 gpl |
| Differential level | 13.2 in. |

EXAMPLE 2

This example differs from Example I in several ways. The coating suspension contains only 4% solids. Attapulgite clay is included as a portion of the solids. The suspension contains very little thickener. The coating is applied by immersion of the cathode in the suspension followed by vacuum filtration. The diaphragm is cemented together by impregnation with zirconium oxychloride solution followed by immersion in sodium hydroxide solution and drying.

In this and all subsequent examples, a cathode was provided with a foundation layer of the same type as in Example. For the top coat layer, an aqueous suspension with the following composition was prepared:

| | |
|---|---|
| Zirconium oxide | 3.8% |
| PTFE microfibrils | 0.2% |
| Attapulgite clay | 0.04% |

Thickener, 0.01%; surfactant, 0.02%; antimicrobial, trace; and antifoam, 0.004% were added incidentally with the stock of PTFE microfibrils. Sufficient aqueous suspension was prepared to allow immersion of the cathode. This layer was then applied by vacuum filtration from the stirred suspension. The diaphragm was dried as in Example 1, its weight was 0.61 lb/sq.ft.

The cathode and dried diaphragm assembly were immersed in 16.5% zirconium oxychloride aqueous solution. This was followed by vacuum drainage and by immersion in 10% sodium hydroxide. This process precipitates the zirconium as the hydrous oxide within the pores of the diaphragm. After two hours, the cathode and diaphragm were again placed in an oven to remove water. The drying step converts the zirconium hydrous oxide precipitate into a cementitious binder.

This cathode and diaphragm were operated in a laboratory cell for 103 days. Materials were added to control permeability and pH as in Example 1. On certain occasions, the pH was maintained for a time after the addition. Details of these treatments are given in the following table:

| ADDITIONS TO CELL | | | |
|---|---|---|---|
| Day | Material Added | pH | pH Maintained |
| 34 | $MgCl_2$ as 1% Mg, 0.02 g Mg | 1.0 | no |
| 49 | Attagel ® 50, 0.25 g | 1.0 | no |
| 74 | $Al_2(SO_4)_3$ as 2% Al, 0.2 g Al | no adjustment | |
| | $MgCl_2$ as 1% Mg, 0.02 g Mg | | |
| 94 | Attagel ® 50, 0.25 g | 1.0 | 0.5 hr. |
| 97 | Attagel ® 50, 0.25 g | 1.0 | 1.0 hr. |

The performance data were as follows:

| | |
|---|---|
| Efficiency | 94.5% |
| Voltage | 2.96 |
| NaOH | 113 gpl |
| Differential level | 14.7 in. |

EXAMPLE 3

This example is included to show that a drying step may be included before application of the topcoat, i.e., the sequence of drying steps may be varied.

In this example, the composition of the suspension used for the topcoat was the same as in Example 2, but the topcoat was applied after drying the first layer at 114° to 122° C. The total diaphragm weight after drying the second layer was 0.47 lb/sq.ft. The cell was treated to control permeability as is described in the following table:

| ADDITIONS TO CELL | | | |
|---|---|---|---|
| Day | MaterialAdded | pH | pH Maintained |
| 0 | $MgCl_2$ as 1% Mg, 0.05 g Mg | not adjusted | |
| 3 | Attagel ® 50, 0.25 g | 1.0 | not maintained |
| | $MgCl_2$ as 1% Mg, 0.05 g Mg | 1.0 | |
| 4 | Attagel ® 50, 0.25 g | not adjusted | |
| 25 | $Al_2(SO_4)_3$ as 2% Al, 0.2 g Al | not adjusted | |
| | $MgCl_2$ as 1% Mg, 0.02 g Mg | | |
| 45 | Attagel ® 50, 0.25 g | 1.0 | 1.0 hr. |

The average performance data for 54 days were as follows:

| | |
|---|---|
| Efficiency | 95.0% |
| Voltage | 2.99 |
| NaOH | 113 gpl |
| Differential level | 13.3 in. |

EXAMPLE 4

This example is included to show the method of topcoat application may be widely varied.

A topcoat was applied by pumping a suspension containing 50% solids through a tube whose open end was pointed at the foundation layer surface while a vacuum was applied. Three coats were applied with intervals of air-drying with a 15 to 16-inch Hg vacuum. The composition of the suspension was as follows:

| | |
|---|---|
| Zirconium oxide (Zirox ® 180, TAM Ceramics Co.) | 47.4% |
| PTFE microfibrils | 2.5% |
| Hydroxyethylcellulose | 0.24% |
| Glutaraldehyde | 0.005% |
| Nonionic surfactant | 0.48% |
| Antifoam | 0.10% |
| Sodium hydroxide to pH 8 to 10 | |
| Water | balance |

Vigorous agitation of the mixture had entrained air bubbles which were not readily removed. Therefore, the suspension was vacuum degassed prior to application. The diaphragm was dried at 114° to 119° C. for 51 minutes. The diaphragm weight at this point was 0.53 lb/sq.ft.

The diaphragm was impregnated with 16.5% zirconium oxychloride solution, vacuum drained, immersed in 10% sodium hydroxide solution for two hours, and dried at 114° to 122° C. for 23 hours.

This cell was operated for one month, during which time an addition of 0.05 g Mg as $MgCl_2$ at pH 1.3, an acid-only anolyte treatment to pH 1.0 and an addition of 0.25 g Attagel ® 50 at pH 1.2 were made on three separate occasions. The average performance data for 30 days were as follows:

| | |
|---|---|
| Efficiency | 92.4% |
| Voltage | 2.91 |
| NaOH | 113 gpl |
| Differential level | 23.2 in. |

The data indicates a more desirable permeability was produced by this technique. However, the efficiency was not as high as in other examples.

EXAMPLE 5

This example is included to show zirconium silicate and fibers other than PTFE microfibrils may be included in the topcoat formulation.

The aqueous suspension for the topcoat had the following composition:

| | |
|---|---|
| Zirconium silicate (Zircopax ® A, TAM Ceramics Co.) | 9.0% |
| PTFE microfibrils | 0.77% |
| PTFE 6.6 den.floc | 0.62% |
| Hydroxyethylcellulose | 0.30% |
| Glutaraldehyde | 0.006% |
| Nonionic surfactant | 0.58% |
| Antifoam | 0.12% |
| Sodium hydroxide to pH 8 to 10 | |
| Water | balance |

The suspension was applied to the foundation layer by repeatedly dipping and draining the cathode for six cycles in a period of 4 minutes during which the vacuum was allowed to increase from 3.5 in. to 6.5 in. Hg and during which 90 mL of filtrate were recovered. The diaphragm was allowed to dry at ambient temperature overnight. A dipping for 30 minutes at 7 in. Hg vacuum failed to produce additional filtrate. The diaphragm was dried in an oven at 114° to 122° C. for 34 minutes. The diaphragm weight was 0.44 lb/sq.ft. Addition weight was desired; therefore, the diaphragm was dipped again at a 12-in. Hg vacuum. Although filtrate was not produced, redrying showed the diaphragm weight had increased to 0.47 lb/sq.ft. No further treatment was applied. During operation, magnesium chloride and Attagel 50 were added. In each case, except the first, sufficient hydrochloric acid was added to the anolyte to adjust the pH to 1.0, but no attempt was made to maintain that pH for a period of time. The feed rate was increased as usual when the addition was made.

| Day | Material Added |
|---|---|
| 0 | $MgCl_2$ as 1% Mg, 0.02 g Mg |
| 1 | Attagel ® 50, 0.25 g |
| 3 | $MgCl_2$ as 1% Mg, 0.05 g Mg<br>Attagel ® 50, 0.25 g |
| 10 | Attagel ® 50, 0.25 g |
| 21 | $MgCl_2$ as 1% Mg, 0.05 g Mg |
| 50 | $MgCl_2$ as 1% Mg, 0.05 g Mg |
| 56 | $MgCl_2$ as 1% Mg, 0.05 g Mg |
| 64 | $MgCl_2$ as 1% Mg, 0.05 g Mg<br>Attagel ® 50, 0.25 g |
| 87 | Attagel ® 50, 0.50 g |

The average performance data for 108 days were as follows:

| | |
|---|---|
| Efficiency | 94.2% |
| Voltage | 2.97 |
| NaOH | 113 gpl |
| Differential level | 9.1 in. |

This diaphragm was much more permeable and required more additions than usual. This is believed to be due to the omission of the in situ formation of magnesium hydroxide or zirconium hydrous oxide provided in the preceding Examples.

EXAMPLE 6

This example is included to show the ratio of PTFE microfibrils to the inorganic material in the topcoat may be varied widely. A topcoat was deposited from a suspension in which PTFE microfibrils constituted 25% by weight of the suspended solids.

The aqueous suspension for the topcoat had the following composition:

| | |
|---|---|
| Zirconium oxide (Zirox ® 180, TAM Ceramics Co.) | 3.0% |
| PTFE microfibrils | 1.0% |
| Hydroxyethylcellulose | 0.04% |
| Glutaraldehyde | 0.001% |
| Nonionic surfactant | 0.07% |
| Antifoam | 0.01% |
| Sodium hydroxide to pH 8 to 10 | |
| Water | balance |

The topcoat was applied by immersion in the stirred suspension with vacuum filtration. The vacuum control valve was set to produce a vacuum of approximately 4 in. Hg before immersion. As soon as the cathode was immersed, the vacuum was increased to 15 in. When 200 ml of filtrate had been obtained, the cathode assembly was removed from the suspension.

After six minutes of air drainage, the filtrate volume had increased to 250 ml. The cathode was immersed again. When the total filtrate volume had reached 300 ml, the cathode was removed and allowed to drain under vacuum for 22 minutes. The cathode and diaphragm were dried at 114° to 122° C. for 22 minutes. The dried diaphragm weight was 0.43 lb/sq.ft.

The dried diaphragm was immersed in 9% zirconium oxychloride for twenty minutes. After removal from the solution, excess zirconium oxychloride was removed by applying a 10 in. Hg vacuum for 10 minutes. The cathode and diaphragm were immersed in 10% sodium hydroxide solution for two hours, and dried at 114° to 122° C. for 26 hours.

Additions were made to the cell as indicated in the following table:

| ADDITIONS TO CELL | | | |
|---|---|---|---|
| Day | Material Added | pH | pH Maintained |
| 0 | $MgCl_2$ as 1% Mg, 0.075 g Mg<br>Attagel ® 50, 0.25 g | not adjusted | |
| 4 | $MgCl_2$ as 1% Mg, 0.05 g Mg<br>Attagel ® 50, 0.25 g | 1.0 | 1.0 hr. |

The performance data on the fifth day were as follows:

| | |
|---|---|
| Efficiency | 96.1% |
| Voltage | 2.99 |
| NaOH | 117 gpl |
| Differential level | 12.9 in. |

The above examples demonstrate the topcoat can be applied by a variety of methods. The topcoats share in common the following attributes: all were applied from an aqueous suspending medium, the suspended solids all contained PTFE microfibrils, the predominant ingredient of the suspended solids was a sparingly soluble, inorganic solid resistant to chemical attach in the chlorine cell environment, and all were heated and dried after application of the topcoat. Other optional refinements included (1) incorporation of a potentially reactive ingredient capable of forming a precipitate during cell operation through dissolution and reprecipitation and (2) impregnation with a solution containing dissolved inorganic species that are capable of precipitation on exposure of the impregnated diaphragm to an aqueous alkaline solution. The inorganic materials are not limited by particle shape. They may advantageously have an elongated shape to improve the diaphragm pore characteristics or to result in a stronger deposited layer.

The two layer diaphragm's performance has been demonstrated. The advantageous characteristics may include the following:

a. The foundation layer is a more efficient filter than the cathode, itself. Therefore, the second layer can contain predominantly small particles. These small particles would not have been retained, if they had been included in the first layer deposited directly onto the cathode.

b. The second layer, consisting of much smaller particles than the first layer, is inherently more uniform. Therefore, higher efficiency is possible than in a single layer, relatively large fiber diaphragm of comparable thickness.

c. The smaller pores of the second layer result in increased anolyte level in the cell. An appreciable level is needed to ensure that the diaphragm is held in place during cell operation.

d. The second layer is capable of fulfilling the barrier function of the diaphragm; therefore, greater freedom is allowed in the characteristics of the foundation layer.

Although the invention has been described and illustrated in some detail by the foregoing, many variations therein will be apparent to those skilled in the art without departing from the spirit and scope of the invention as defined by the appended claims. For example, even though the invention was made (and is so illustrated) for improving the performance characteristics of chlor-alkali diaphragms composed principally of thermoplastic fibrous material, e.g. polytetrafluoroethylene fibers, of the type described, e.g. in U.S. Pat. No. 4,720,334; the invention is believed applicable to use with any type of fibrous chlor-alkali diaphragm, e.g., asbestos or polymer modified asbestos diaphragms.

We claim:

1. A liquid-permeable diaphragm for use in an electrolytic chlor-alkali cell having an anolyte compartment containing an anode, a catholyte compartment containing a permeable cathode, and a non-asbestos diaphragm on said cathode which separates said anolyte and catholyte compartments, said diaphragm being prepared by:

(a) providing on said cathode a layer of asbestos-free diaphragm material comprising fibrous synthetic polymeric material resistant to the cell environment, (b) depositing on a surface of the diaphragm material facing the anode a first topcoat of;

(i) water-insoluble, inorganic, particulate refractory material selected from the group consisting of silicon carbide, the oxides, borides, carbides, silicates or nitrides of valve materials selected from the group consisting of vanadium, chromium, zirconium, niobium, molybdenum, hafnium, tantalum, titanium and tungsten, and mixtures of such particulate refractory materials, and (ii) zirconia fibers or organic perfluorinated polymeric fibrous material resistant to the cell environment, (c) impregnating the resultant topcoated diaphragm with an aqueous solution of water-soluble, hydrolyzable inorganic zirconium-containing compound, (d) hydrolyzing thus impregnated zirconium-containing compound, thereby to precipitate and form hydrous oxide of zirconium in the interstices of the topcoat and diaphragm material, and (e) drying the topcoated, hydrous zirconium oxide-containing diaphragm at temperatures below the sintering or melting point of fibrous material of which the diaphragm is formed, thereby to form solid particulate zirconia in the interstices of the topcoat and diaphragm material.

2. The diaphragm of claim 1 wherein the refractory material and the fibrous material are codeposited on the preformed diaphragm by vacuum deposition from an aqueous slurry of the refractory material and the fibrous material.

3. The diaphragm of claim 2 wherein the fibrous material codeposited on the preformed diaphragm is polytetrafluoroethylene.

4. The diaphragm of claim 1 wherein the refractory material codeposited on the preformed diaphragm is selected from zirconium oxide, zirconium silicate or mixtures thereof.

5. The diaphragm of claim 1 wherein a fibrous synthetic polymeric material provided on said cathode as diaphragm material is a perfluorinated polymeric material.

6. The diaphragm of claim 5 wherein polytetrafluoroethylene fiber is used as a fibrous synthetic perfluorinated polymeric material provided on said cathode.

7. The diaphragm of claim 1 wherein the amount of first topcoat material deposited on the diaphragm, on a dry basis, is from about 0.05 to about 0.5 pounds per square foot of diaphragm cathode surface.

8. The diaphragm of claim 1 wherein the hydrolyzable inorganic zirconium-containing compound is selected from the group consisting of zirconyl halide, zirconium ammonium carbonate and zirconyl sulfate.

9. The diaphragm of claim 8 wherein the zirconyl halide is zirconyl chloride.

10. The diaphragm of claim 1 wherein the inorganic zirconium-containing compound is hydrolyzed by contact with an aqueous solution of sodium hydroxide.

11. The diaphragm of claim 1 wherein the drying of the diaphragm in step (e) is performed at temperatures of from 90° C. to about 150° C. for up to about 20 hours.

12. The diaphragm of claim 1 wherein the surface of the first topcoat is dried prior to impregnating the topcoated diaphragm with hydrolyzable zirconium-containing compound.

13. The diaphragm of claim 1 wherein the topcoated and hydrolyzable zirconium-containing compound impregnated diaphragm of step (c) is partially dewatered to remove excess aqueous solution of hydrolyzable zirconium-containing compound prior to the hydrolysis thereof in step (d).

14. The diaphragm of claim 1 wherein the amount of solid particulate zirconia formed in said topcoat and diaphragm material is from about 0.01 to about 0.1 pounds per square foot of diaphragm cathode surface area.

15. A liquid-permeable diaphragm for use in an electrolytic chlor-alkali cell having an anolyte compartment containing an anode, a catholyte compartment containing a permeable cathode, and a non-asbestos diaphagm on said cathode which separates said anolyte and catholyte compartments, said diaphragm being prepared by:

(a) providing on said cathode a layer of asbestos-free diaphragm material comprising fibrous perfluorinated synthetic polymeric material resistant to the cell environment, (b) depositing on a surface of the diaphragm material facing the anode a first topcoat of:

(i) water-insoluble, inorganic particulate refractory material selected from the group consisting of silicon carbide, the oxides, borides, carbides, silicates or nitrides of valve metals selected from the group consisting of vanadium, chromium, zirconium, niobium, molybdenum, hafnium, tantalum, titanium and tungsten, and mixtures of such particulate refractory materials, and (ii) organic perfluorinated fibrous material resistant to the cell environment, said deposited fibrous material being up to about 50 weight percent of the solids content of the first topcoat, (c) impregnating the resultant topcoated diaphragm with an aqueous solution of water-soluble, hydrolyzable inorganic zirconium-containing compound selected from the group consisting of zirconyl halide, zirconium ammonium carbonate and zirconyl sulfate, (d) hydrolyzing thus impregnated zirconium-containing compound, thereby to precipitate and form hydrous oxide of zirconium in the interstices of the topcoat and diaphragm material, and (e) drying the topcoated, hydrous zirconium oxide-containing diaphragm at temperatures below the sintering or melting point of the fibrous material of which the diaphragm is formed, thereby to form substantially solid particulate zirconia in the interstices of the topcoat and diaphragm material.

16. The diaphragm of claim 15 wherein polytetrafluoroethylene fiber is used as a fibrous synthetic perfluorinated polymeric material provided on said cathode as diaphragm material.

17. The diaphragm of claim 16 wherein the topcoat comprises:

(i) inorganic particulate refractory material selected from the group consisting of zirconium oxide, zirconium silicate and mixtures of such refractory materials, and (ii) polytetrafluoroethylene fibers.

18. The diaphragm of claim 17 wherein the surface of the first topcoat is dried prior to impregnating the topcoat with the aqueous solution of hydrolyzable inorganic zirconium-containing compound.

19. In the process of electrolyzing sodium chloride in an electrolytic diaphragm cell having an anolyte compartment containing an anode, a catholyte compartment containing a cathode, and a liquid permeable diaphragm that separates said anolyte and catholyte compartments, wherein the improvement comprises using as the diaphragm a diaphragm defined by claims 1, 15, 17 or 18.

20. The diaphragm of claims 17 or 18 wherein the water-soluble hydrolyzable zirconium-containing compound is zirconyl chloride.

21. The diaphragm of claim 20 wherein the topcoated and hydrolyzable zirconium-containing compound impregnated diaphragm of step (c) is partially dewatered to remove excess aqueous solution of hydrolyzable zirconium-containing compound prior to the hydrolysis thereof in step (d).

22. The diaphragm of claim 21 wherein the hydrolyzable zirconium-containing compound is hydrolyzed with aqueous sodium hydroxide.

23. The diaphragm of claim 22 wherein the drying of the diaphragm in step (e) is performed at from about 90° C. to about 150° C. for up to about 20 hours.

24. The diaphragm of claim 23 wherein the amount of first topcoat material deposited on the diaphragm, on a dry basis, is from about 0.05 to about 0.5 pounds per square foot of diaphragm cathode surface, and the amount of solid particulate zirconia formed in said topcoat and diaphragm material is from about 0.01 to about 0.1 pounds per square foot of diaphragm cathode surface area.

25. In the process of electrolyzing sodium chloride in an electrolytic diaphragm cell having an anolyte compartment containing an anode, a catholyte compartment containing a cathode, and a liquid permeable diaphragm that separates said anolyte and catholyte compartments, wherein the improvement comprises using as the diaphragm a diaphragm defined by claim 24.

26. The diaphragm of claim 21 wherein the layer of diaphragm material provided in step (a) is dried before depositing the topcoat thereon.

27. In the process of electrolyzing sodium chloride in an electrolytic diaphragm cell having an anolyte compartment containing an anode, a catholyte compartment containing a cathode, and a liquid permeable diaphragm that separates said anolyte and catholyte compartments, wherein the improvement comprises using as the diaphragm a diaphragm defined by claim 21.

28. The diaphragm of claim 20 wherein the zirconyl chloride is hydrolyzed by contact with a base material selected from the group consisting of aqueous sodium hydroxide, aqueous potassium hydroxide, cell liquor, ammonium hydroxide and ammonium gas.

29. The diaphragm of claim 20 wherein the hydrolyzable zirconium-containing compound is hydrolyzed with aqueous sodium hydroxide.

30. The diaphragm of claim 29 wherein the drying of the diaphragm in step (e) is performed at from about 90° C. to about 150° C. for up to about 20 hours.

31. The diaphragm of claim 30 wherein the amount of first topcoat material deposited on the diaphragm, on a dry basis, is from about 0.05 to about 0.5 pounds per square foot of diaphragm cathode surface, and the amount of solid particulate zirconia formed in said topcoat and diaphragm material is from about 0.01 to about 0.1 pounds per square foot of diaphragm cathode surface area.

32. The diaphragm of claim 31 wherein the layer of diaphragm material provided in step (a) is dried before depositing the topcoat thereon.

* * * * *

UNITED STATES PATENT AND TRADEMARK OFFICE

CERTIFICATE OF CORRECTION

PATENT NO. : 5,188,712

DATED : February 23, 1993

INVENTOR(S) : Colonel R. Dilmore et al

It is certified that error appears in the above-identified patent and that said Letters Patent is hereby corrected as shown below:

Column 12, line 23, after "fibrous" insert --perfluorinated--.

Column 12, line 27, delete "or" and substitute --and--.

Signed and Sealed this

Twenty-eight Day of March, 1995

*Attest:*

Bruce Lehman

BRUCE LEHMAN

*Attesting Officer*

*Commissioner of Patents and Trademarks*